US006817703B2

(12) United States Patent
Lee

(10) Patent No.: US 6,817,703 B2
(45) Date of Patent: Nov. 16, 2004

(54) DRIVING CIRCUIT AND METHOD FOR AN INKJET PRINTHEAD

(75) Inventor: Cheng-Loung Lee, Taoyuan (TW)

(73) Assignee: BENQ Corporation, Taoyuan (TW)

( * ) Notice: Subject to any disclaimer, the term of this patent is extended or adjusted under 35 U.S.C. 154(b) by 89 days.

(21) Appl. No.: 10/353,207

(22) Filed: Jan. 27, 2003

(65) Prior Publication Data

US 2003/0142157 A1 Jul. 31, 2003

(30) Foreign Application Priority Data

Jan. 28, 2002 (TW) ..... 91101409 A

(51) Int. Cl.[7] ..... B41J 2/05
(52) U.S. Cl. ..... 347/57
(58) Field of Search ..... 347/57, 56, 54, 347/10, 12, 13, 11, 14, 41, 42, 20, 1, 5

(56) References Cited

U.S. PATENT DOCUMENTS 5,933,161 A 8/1999 Sato et al. ..... 347/12

FOREIGN PATENT DOCUMENTS

EP 0 678 386 A2 10/1995
JP 2001199054 A 7/2001

*Primary Examiner*—Raquel Yvette Gordon
(74) *Attorney, Agent, or Firm*—Ladas & Parry LLP

(57) ABSTRACT

This present invention is to provide a driving circuit and method for an inkjet printhead. The driving circuit includes a group of group-driving lines, a group of column-driving lines and a group of row-driving lines. The printhead includes a plurality of driving groups which are driven by driving signals inputted in sequence via the corresponding group-driving lines. Each driving group includes a plurality of actuator and control switches which are driven by driving signals inputted via the corresponding column-driving line and row-driving line. Each control switch is just driven when the corresponding group-driving line, column-driving line and row-driving line input driving signals at the same time. Then, the driven control switch conducts the electric current to the corresponding actuator so as to jet out the ink in the ink chamber.

22 Claims, 8 Drawing Sheets

DRIVING CIRCUIT AND METHOD FOR AN INKJET PRINTHEAD

FIELD OF THE INVENTION

The present invention relates to a driving circuit and method for a inkjet printhead, and particularly a driving circuit and method which can effectively reduce the related components and lines by sharing the address lines.

BACKGROUND OF THE INVENTION

FIG. 1 illustrates a diagram of a printhead and driving circuit for a conventional inkjet device. In the conventional design of the printhead 10 for the inkjet device, the printhead 10 includes many ink chambers $R_{ij}$. Each ink chambers $R_{ij}$ includes a control switch $C_{ij}$ and an actuators $H_{ij}$. A driving circuit 20 controls whether these ink chambers $R_{ij}$ eject ink or not. The driving circuit 20 of the printhead 10 includes a driving controller 22 and a plurality of address lines $A_i$ (i=1~n) and a plurality of paper lines, $P_j$ (j=1~m), or so called data lines, arranged in a matrix. In this configuration, the address lines are arranged in columns and the paper lines arranged in rows. Each address line $A_i$ and paper line $P_j$ are connected to the corresponding control switch $C_{ij}$ and the actuator $H_{ij}$.

The driving controller 22 generates driving signals to the plurality of address lines $A_i$ and paper lines $P_j$. The actuator $H_{ij}$ is driven in such a way when the corresponding control switch $C_{ij}$ is conducted by the simultaneous inputted driving signals from the corresponding address line $A_i$ and paper line $P_j$. If the control switch $C_{ij}$ is conducted, the corresponding actuator $H_{ij}$ will generate an outward force to allow ejection of the ink from the ink chamber $R_{ij}$.

FIG. 2 illustrates a timing diagram of the driving circuit for the conventional inkjet device. The driving method for the driving circuit described above is explained as follows. The address lines are inputted with driving signals in sequence, such as in the order from $A_1$ to $A_n$ or $A_n$ to $A_1$, to drive the following circuit elements. For example, during time period $T_1$ to $T_2$, only the address line $A_1$ shows a high level signal 24, that means during that time period, only the address line $A_1$ is inputted with the driving signal. Therefore, the address line $A_1$ is active during $T_1$ to $T_2$. Similarly, during time period $T_2$ to $T_3$, only the address line $A_2$ shows a high level signal 26, therefore that means during that time period, only the address line $A_2$ is inputted with the driving signal. Therefore, the address line $A_2$ is active during $T_2$ to $T_3$. In another words, the characteristic of the timing diagram is in that only one of the plurality of the address lines is active at the same time period, however, there would be possibility that all of the paper lines $P_1$~$P_m$ are driven and keep in an active state at the same time period when one address line is driven.

Thus, it is assumed that the control switch $C_{ij}$ is controlled and driven by the address line $A_i$ and the paper line $P_j$. Only when the driving signals from the address line $A_i$ and the paper line $P_j$ are transmitted to the corresponding control switch $C_{ij}$ at the same time period, then the control switch $C_{ij}$ would be driven and conducted. Consequently, the conducted control switch $C_{ij}$ would then allow the electric current to flow through the corresponding actuator $H_{ij}$ so as to eject the ink in the ink chamber $R_{ij}$. If only one, or none of the driving signal from the address line $A_i$ and the paper line $P_j$ is transmitted to the corresponding control switch $C_{ij}$, the control switch $C_{ij}$ would not be conducted and the ink in the ink chamber would not be ejected. When all the address lines are driven for a complete cycle (from $T_1$ to $T_n$ time period), it means that all the actuators for controlling the corresponding ink chambers have been driven once, and the next cycle will start at the time $T_{n+1}$. In the above descriptions for the conventional driving circuit 20, it can be referred that (n+m) lines can control (n×m) actuators at most.

The number of the address line n and the number of the paper line m can determine the maximum controllable number $N_H$ of the ink chambers in the printhead. The following condition must be satisfied: $N_H \leqq n \times m$. That means one address line accompanying one paper line can control only one control switch of one actuator. However, during the same time period, only one address line is inputted with the driving signal and thus in an active state. The other address lines are in the idle state. It means the efficiency of the address lines is too low due to the aforementioned limitation. Furthermore, the conventional driving circuit would become too complex because of the limitation.

Therefore, there is a need to design a new driving circuit to overcome the above limitation and disadvantages. The new driving circuit has to improve the efficiency of the address lines and at the same time, substantially remains the conventional production process of the driving circuit without a distinctive change therein.

SUMMARY OF THE INVENTION

The object of the present invention is to provide a driving circuit for an inkjet printhead to improve the efficiency of the address lines. The present invention reduces the n conventional address lines to n' group-driving lines and n" column-driving lines, wherein n=n'×n", n>n'+n". of the conventional driving method in the prior art that drives an address line at one period of time would be changed to the driving method in the present invention that drives at least a group-driving line and one of the column-driving lines. All the control switches would be divided into different driving groups to be driven by the different group-driving lines. In this configuration, the column-driving lines can be substantially reduced and repeatedly utilized in different driving groups. The number of the conventional address lines can be reduced and consequently, the efficiency is improved. That means, while remaining the control of the same number of the ink chambers, the number of control lines between the printhead and driving circuit can be substantially reduced. This also leads to the decrease of the complexity of external driving circuit for an inkjet printhead.

Another object of the present invention is to provide a driving circuit for an inkjet printhead, which substantially remains the same fabrication procedures. The fabrication procedures of the group-driving lines and the column-driving lines of the present invention is similar to, with only a little difference with, the fabrication procedures of the conventional address lines. Therefore, the cost is not dramatically raised due to the application of the present invention.

The present invention is a driving circuit for an inkjet printhead. The driving circuit comprises a group of group-driving lines, a group of column-driving lines, and a group of row-driving lines. The printhead comprises a plurality of driving groups being driven by the driving signals from the group of group-driving lines. Each driving group comprises a plurality of actuators and control switches being driven by the driving signals from the corresponding column-driving lines and row-driving lines. A control switch is driven and conducted only when the driving signals from a corresponding group-driving line, a corresponding column-driving line and a corresponding row-driving line arrive at the same time period. And a corresponding actuator is accordingly driven to actuate the corresponding ink chamber. The characteristic of the present invention is in that all the control switches in different driving groups are driven by the same group of column-driving lines and the same group of row-driving lines, as long as distinguished by the accompanying different group-driving lines.

When a driving group is driven by a corresponding group-driving line, only those control switches, which at the same time are driven by the corresponding column-driving lines and row-driving lines, of the aforementioned driving group are conducted. The other control switches not of the aforementioned driving group are not conducted.

The advantage and spirit of the invention may be understood by the following recitations together with the appended drawings.

BRIEF DESCRIPTION OF THE APPENDED DRAWINGS

DETAILED DESCRIPTION OF THE INVENTION

In order to increase the efficiency of the address lines, the present invention provides a simple decoding method for the address lines. To begin with, the printhead mentioned above is directed to a chip comprising a plurality of actuators. It is clarified that the chip can be integrated in the ink jet cartridge or a separate component out of the ink jet cartridge.

Figure 1:
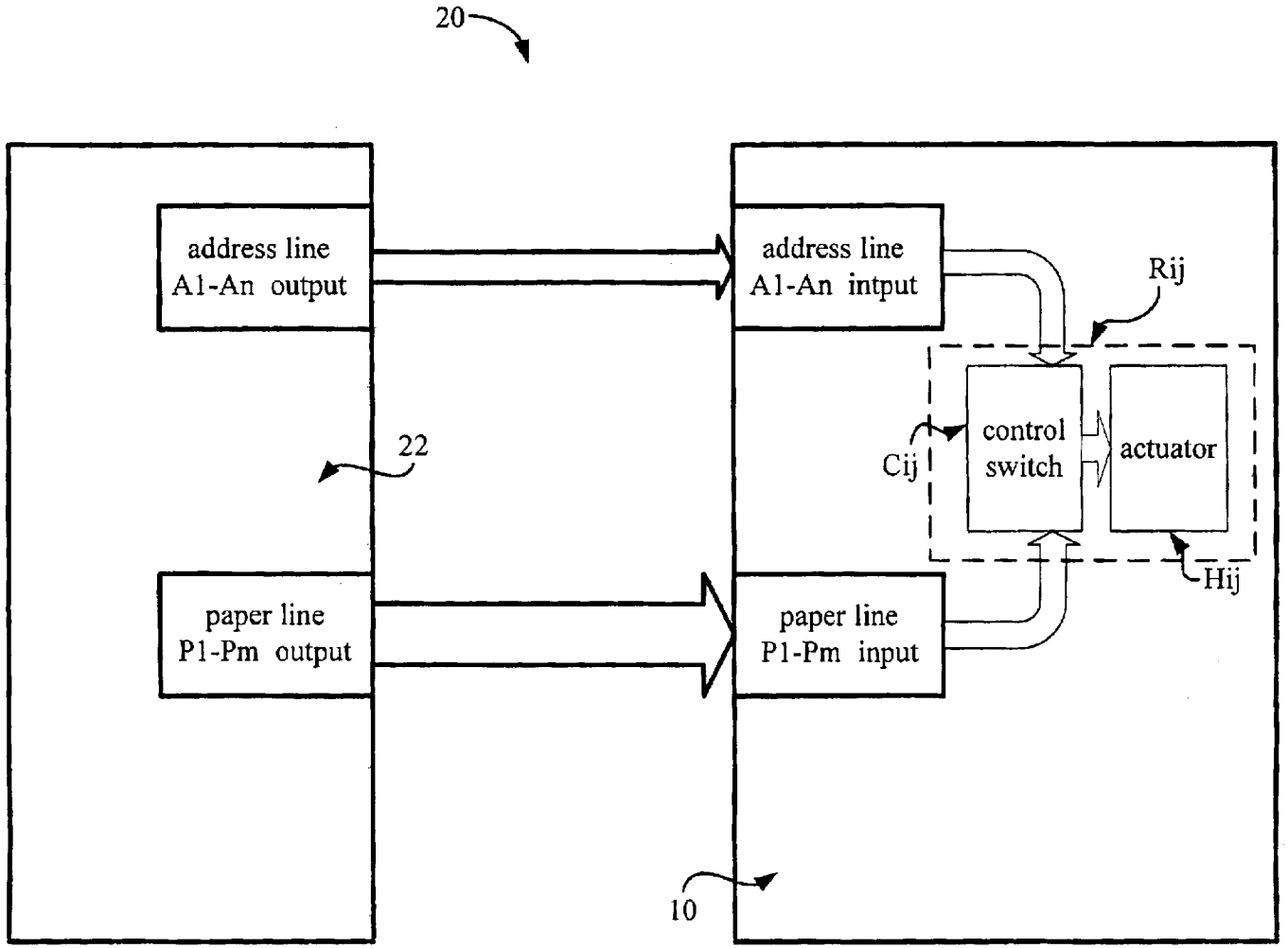
Fig.1 Prior Art
FIG. 1 is a diagram of the driving circuit and the inkjet printhead in the inkjet device of the prior art.
Figure 2:
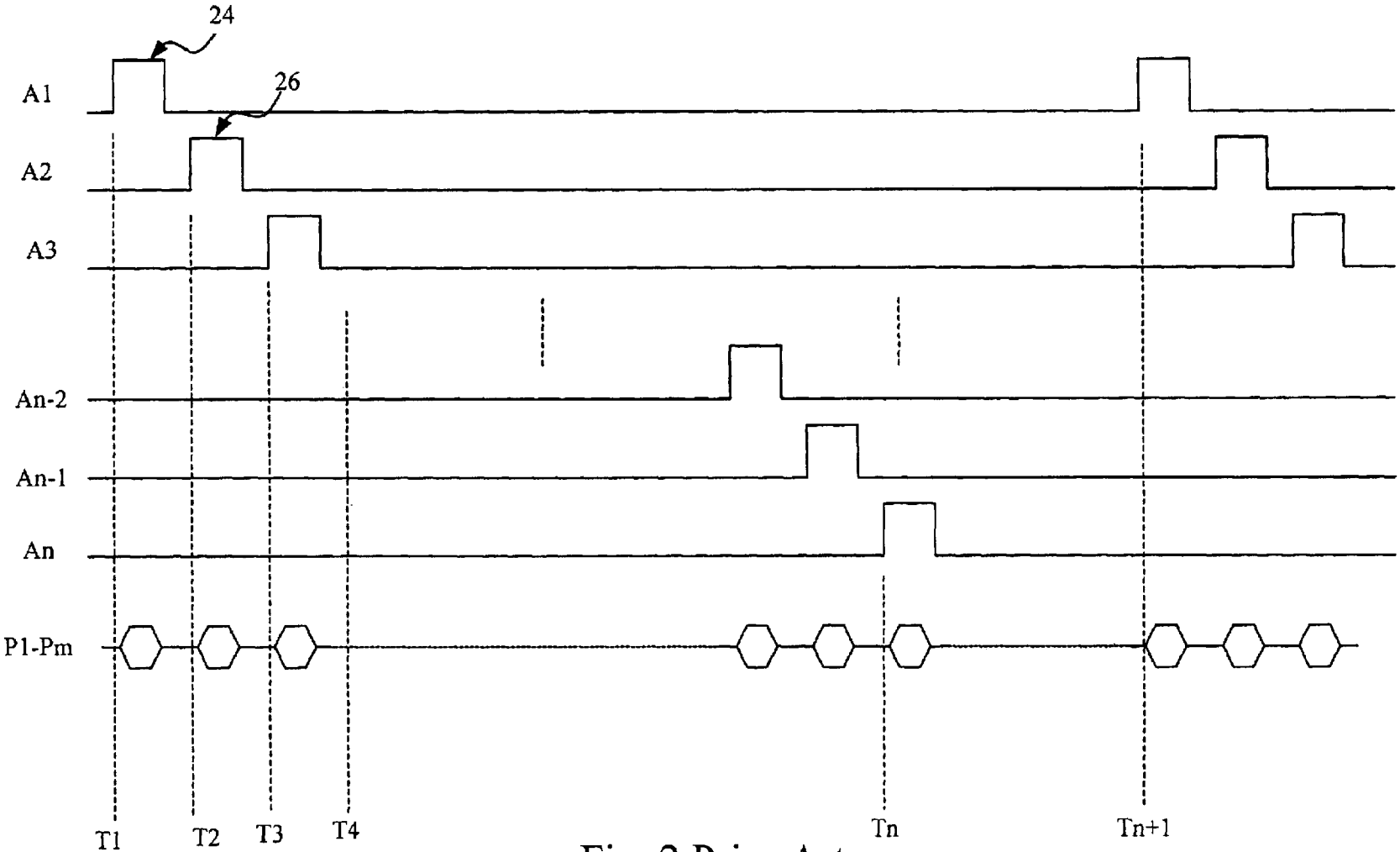
Fig. 2 Prior Art
FIG. 2 is a control time sequence diagram in the inkjet device of the prior art.
Figure 3:
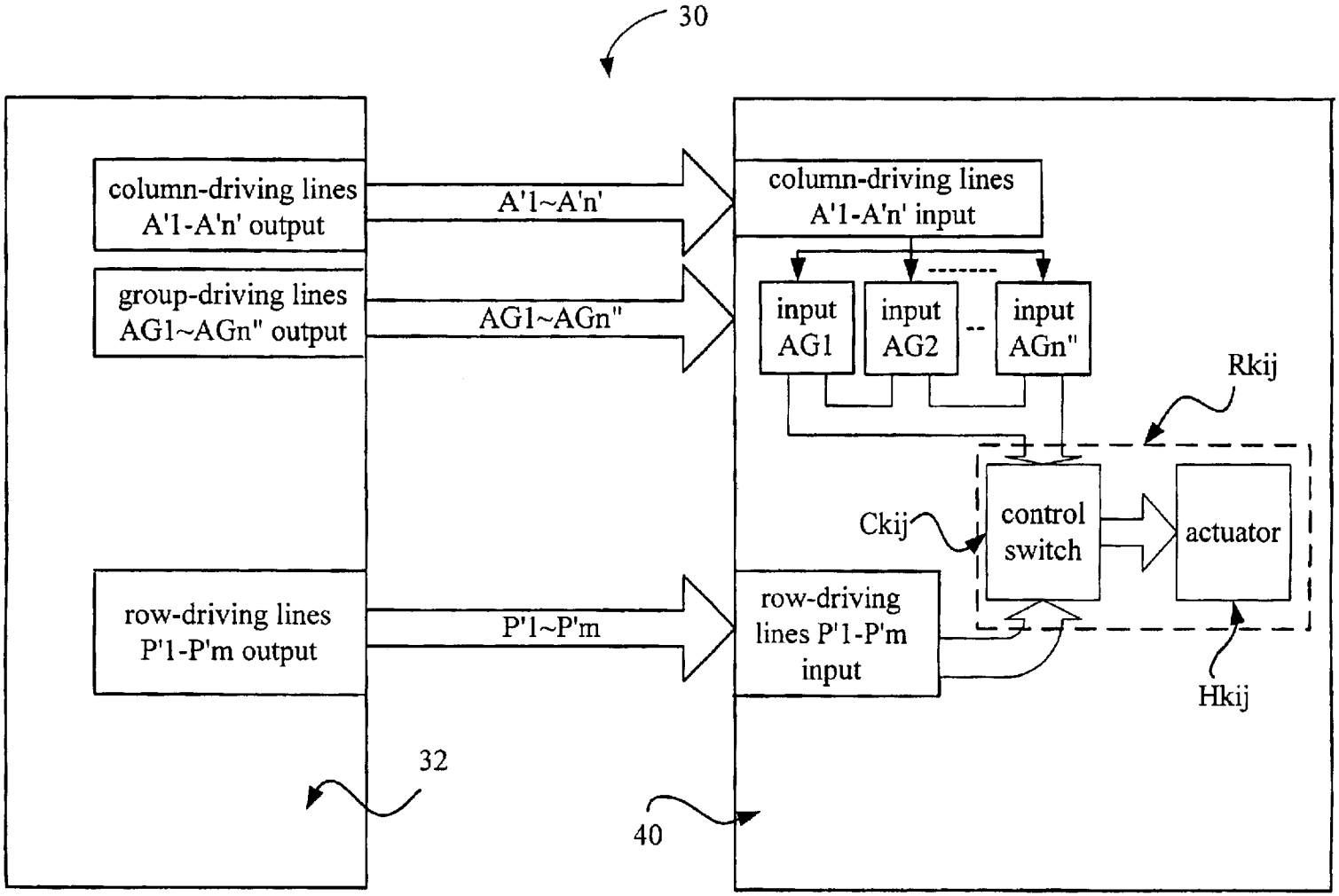
FIG. 3 is a diagram of the driving circuit and the inkjet printhead in the inkjet device of the present invention.
Figure 4:
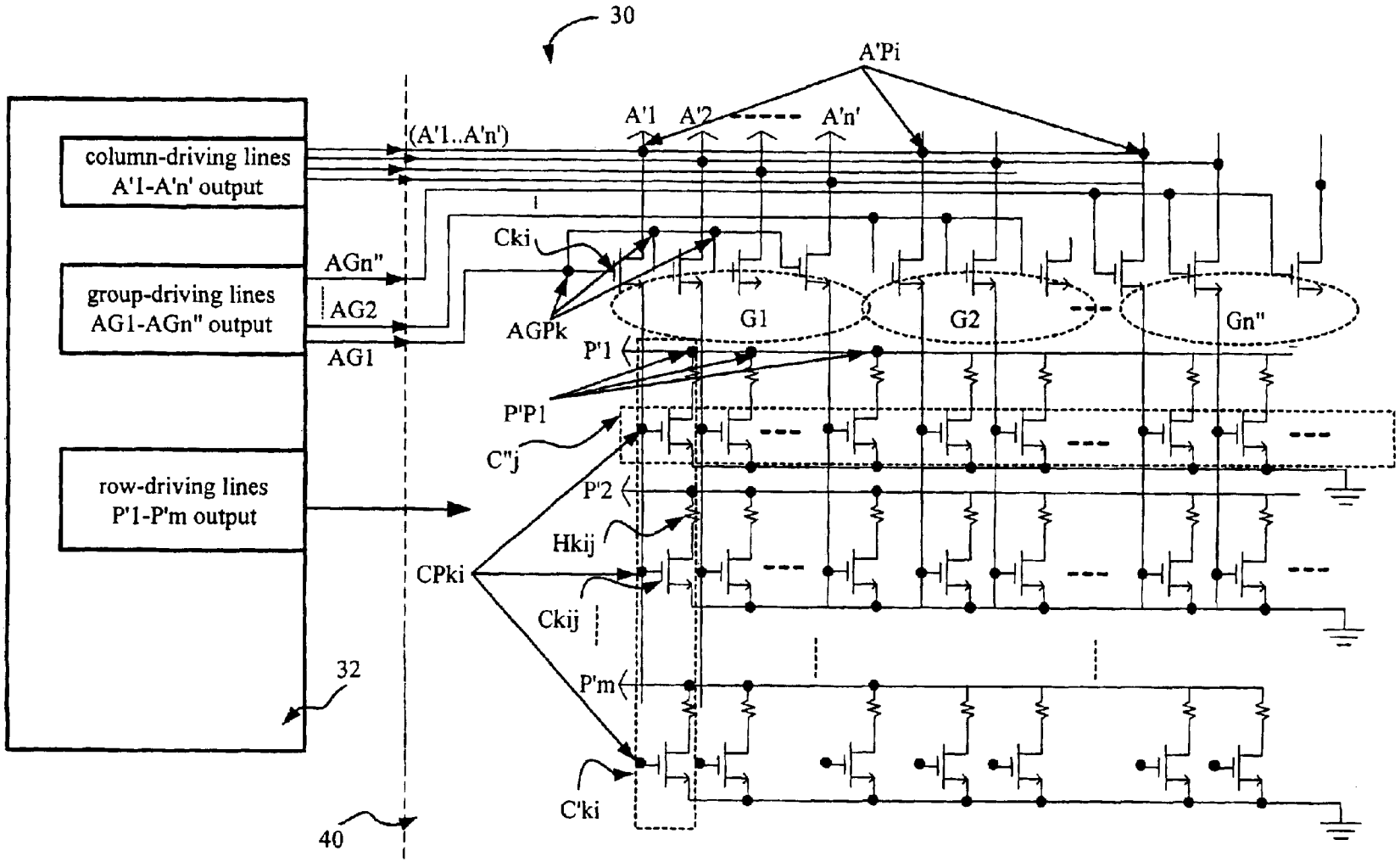
FIG. 4 is a circuit diagram of the first embodiment of the present invention.

Please refer to FIG. 3 and FIG. 4. FIG. 3 is a diagram of the driving circuit and the inkjet printhead in the inkjet device of the present invention. FIG. 4 is a circuit diagram of the first embodiment of the present invention. The first embodiment of the present invention is a driving circuit 30 for driving an inkjet printhead 40. The printhead 40 comprises a plurality of driving groups $G_k$ (k=1~n"). Each driving group $G_k$ comprises a plurality of control switches $C_{kij}$ and actuators $H_{kij}$ (i=1~n', j=1~m) arranged in a matrix. There includes a plurality of control switch columns $C'_{ki}$ and control switch rows $C''_j$. The actuator $H_{kij}$ can be the Heating resistor or the Piezoelectric actuator. The driving circuit further comprises a driving controller 32, a group of column-driving lines $A'_i$, a group of row-driving lines $P'_j$, and a group of group-driving lines $AG_k$ (k=1~n"), which are never disclosed in the prior art. These elements in the driving circuit 30 are used to drive the printhead 40. The driving controller 32 is used for generating driving signals via the group of group-driving lines $AG_k$, the group of column-driving lines $A'_i$, and the group of row-driving lines $P'_j$ to drive the corresponding control switches $C_{kij}$ in the printhead 40.

Figure 5:
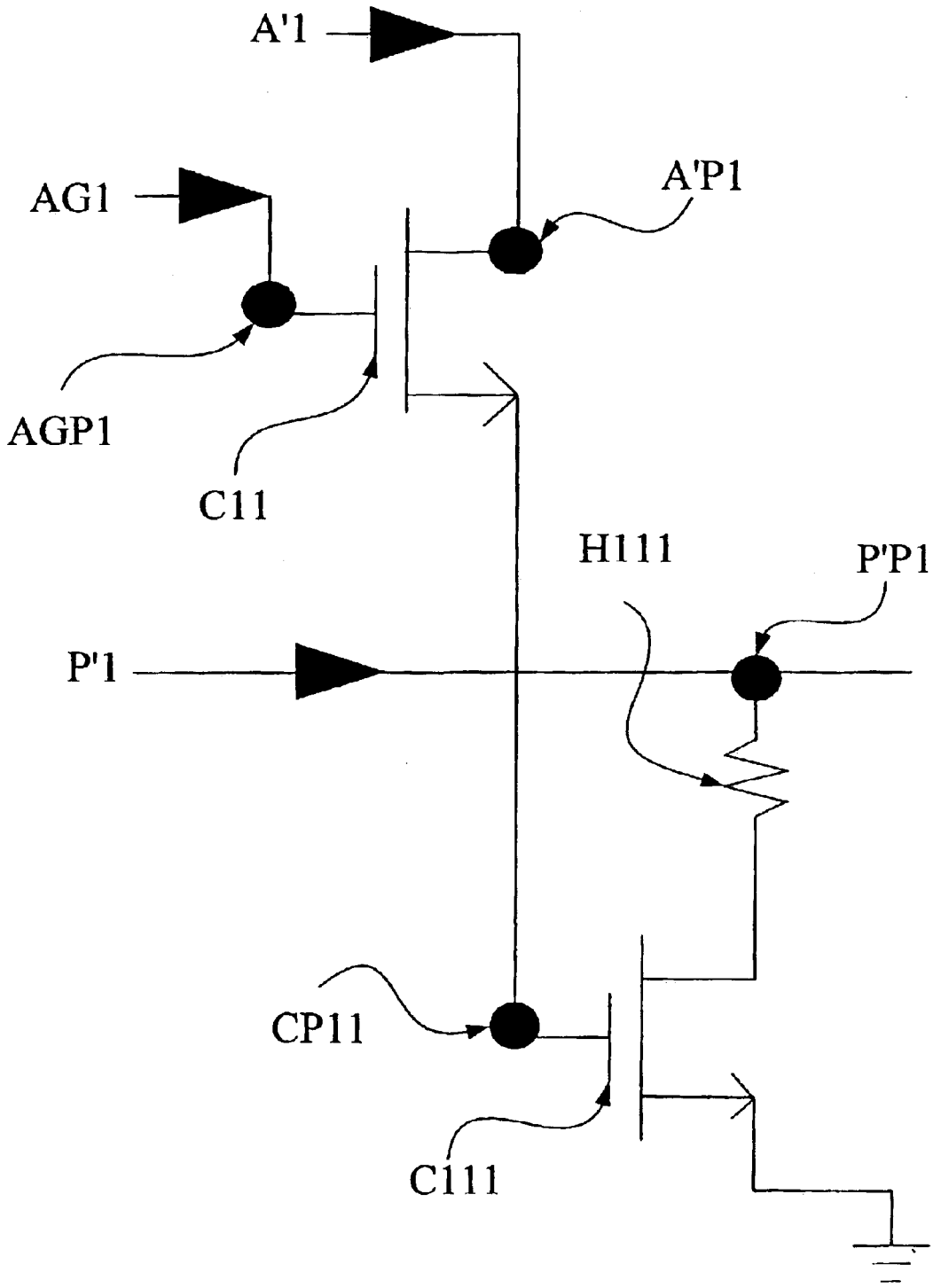
FIG. 5 is an illustrative circuit diagram of the control switch $C_{111}$.

Please refer to FIG. 5. FIG. 5 is an illustrative circuit diagram of the control switch $C_{111}$. When being driven by the driving circuit 30, each driving group $G_k$ in the printhead 40 is driven by each corresponding group-driving line $AG_k$. When a driving group $G_k$ (for example, $G_1$) is driven, the driving controller 32 generates a driving signal via a group-driving line $AG_k$ (for example, $AG_1$) to a point $AGP_k$ (for example, $AGP_1$). Each control switch column $C'_{ki}$ is driven by each corresponding column-driving line $A'_i$ in a predetermined sequence. When a control switch column $C'_{ki}$ (for example, $C'_{11}$) is driven, the driving controller 32 generates a driving signal via a column-driving line $A'_i$ (for example, $A'_1$) to a point $A'P_i$ (for example, $A'P_1$). When the point $AGP_k$ ($AGP_1$) and the point $A'P_i$ ($A'P_1$) all receive the driving signals, a corresponding address control switch $C_{ki}$ (for example, $C_{11}$) is consequently conducted, and the driving signal is allowed to reach the point $CP_{ki}$ (for example, $CP_{11}$).

Each control switch row $C''_j$ is driven by each corresponding row-driving line $P'_j$. To drive a control switch row $C''_j$ (for example, $C''_1$), the driving controller 32 must generate a driving signal via a row-driving line $P'_j$ (for example, $P'_1$) to the point $P'P_j$ (for example, $P'P_1$). Therefore, when the point $CP_{ki}$ ($CP_{11}$) and the point $P'P_j$ ($P'P_1$) all receive the driving signals, a corresponding control switch $C_{kij}$ (for example, $C_{111}$) is driven and conducted, which further allows the current flowing through the corresponding actuator $H_{kij}$ (for example, $H_{111}$). Then the actuator $H_{kij}$ would cause the ejection of the ink in the corresponding ink chamber $R_{kij}$ of the inkjet printhead 40.

Figure 6:
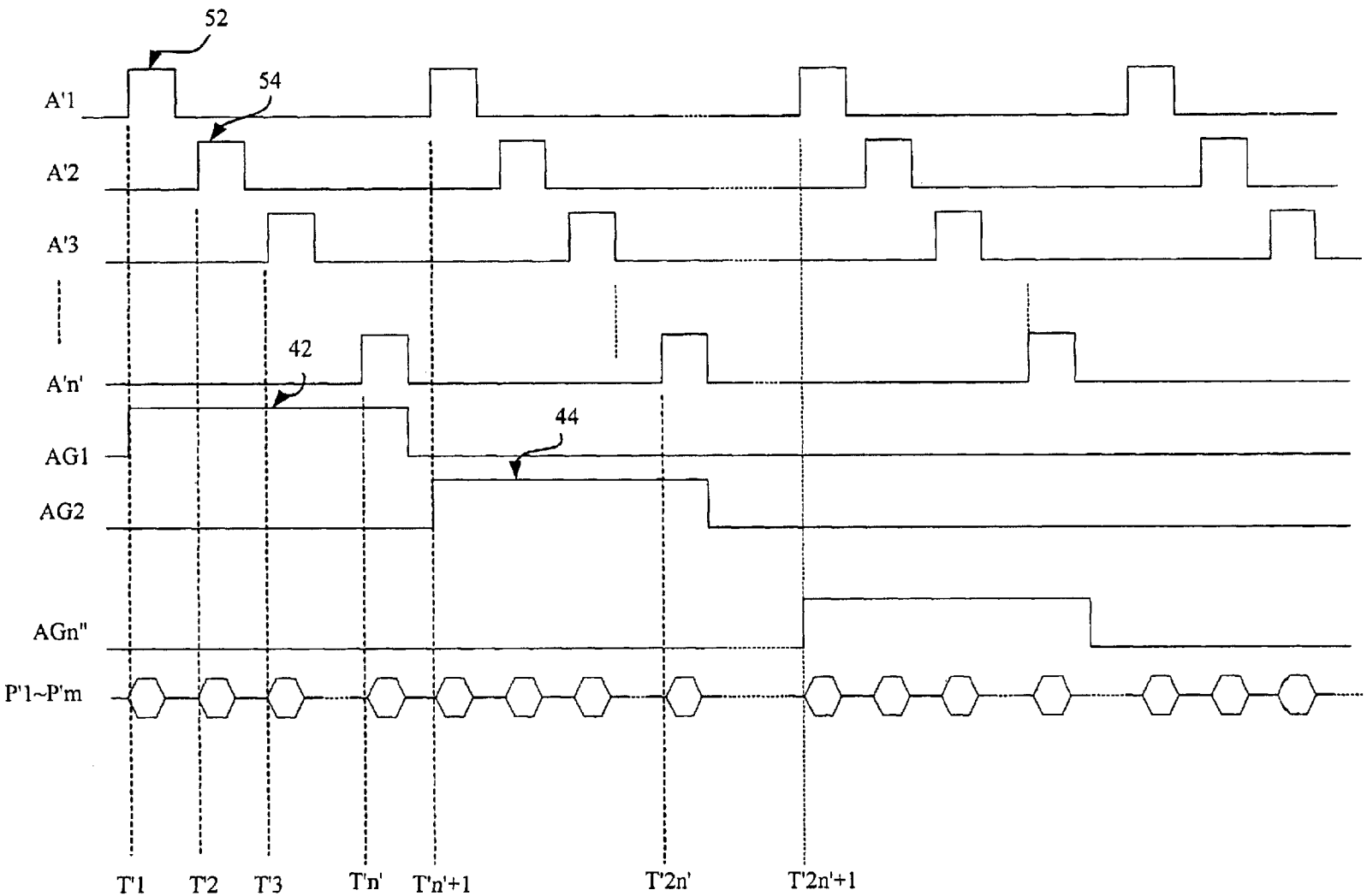
FIG. 6 is a timing diagram of the first embodiment of the present invention.

Please refer to FIG. 6. FIG. 6 is a timing diagram of the first embodiment of the present invention. When the driving circuit is in its normal functionality, the group of group-driving lines $AG_k$ would sequentially drive the corresponding driving group $G_k$ from $AG_1$ to $AG_{n''}$. For example, during time period $T'_1$ to $T'_{n'+1}$, only the group-driving line $AG_1$ possesses a high signal level 42, so that means only the group-driving line $AG_1$ is inputted with the driving signal 42. During time period $T'_{n'+1}$ to $T'_{2n'+1}$, only the group-driving line $AG_2$ has a high signal level 44, so that means only the group-driving line $AG_2$ is inputted with the driving signal 44. During the active time period of a group-driving line, the group of column-driving lines $A'_i$ would drive the corresponding control switch columns $C'_{ki}$ sequentially, such as from $A'_1$ to $A'_{n'}$ or $A'_{n'}$ to $A'_1$. For example, only the column-driving line $A'_1$ has a high level signal 52 during time period $T'_1$ to $T'_2$, so that means only the column-driving line $A'_1$ is inputted with the driving signal 52. Similarly, only the column-driving line $A'_2$ has a high level signal 54 during time period $T'_2$ to $T'_3$, so that means only the column-driving line $A'_2$ is inputted with the driving signal 54. Any time when one column-driving line is driven, the group of row-driving lines $P'_j$ ($P'_1$ to $P'_m$) would transmit the driving signals to the corresponding control switch rows $C''_j$ (C"l to C"m). When all of the column-driving lines are completely driven in one cycle ($A'_1$ to $A'_{n'}$ or $A'_{n'}$ to $A'_1$), the next group-driving line would then be driven. The same group of column-driving lines $A'_i$ repeat to drive the corresponding control switch columns $C'_{ki}$ sequentially, such as from $A'_1$ to $A'_{n'}$ or $A'_{n'}$ to $A'_1$, until all the group-driving lines are finally driven. In this manner, all the actuators in the printhead would be driven one time. To be noticed, the plurality of control switches in different driving groups are driven by the same group of column-driving lines ($A'_1$ to $A'_{n'}$) and the same group of row-driving lines ($P'_1$ to $P'_m$). In the driving circuit 30, (n"+n'+m) driving lines can control (n"×n'×m) actuators.

For example, the number of the actuators is fixed, say (n×m). n is further defined to be n'×n" wherein n' and n" are all positive integers. Because the mathematical expression n'+n"<n'×n" would be valid when n' and n" are all positive integers larger than one, that would lead to the validity of the following mathematical expression (n'+n"+m)<(n+m). As we know that the number of driving lines to drive the (n×m) actuators is now (n'+n"+m), it can be inferred that the number of the driving lines, (n'+n"+m), would be less than that required in the prior art, which is (n+m), because of (n'+n"+m)<(n+m). When n'=n", it can be proved mathematically that the number of the required driving lines would be the minimum. That is to say, the present invention can control the same number of (n×m) actuators in the minimal number of driving lines, by reducing the originally required number (n+m) to the smaller number of (n'+n"+m).

Figure 7:
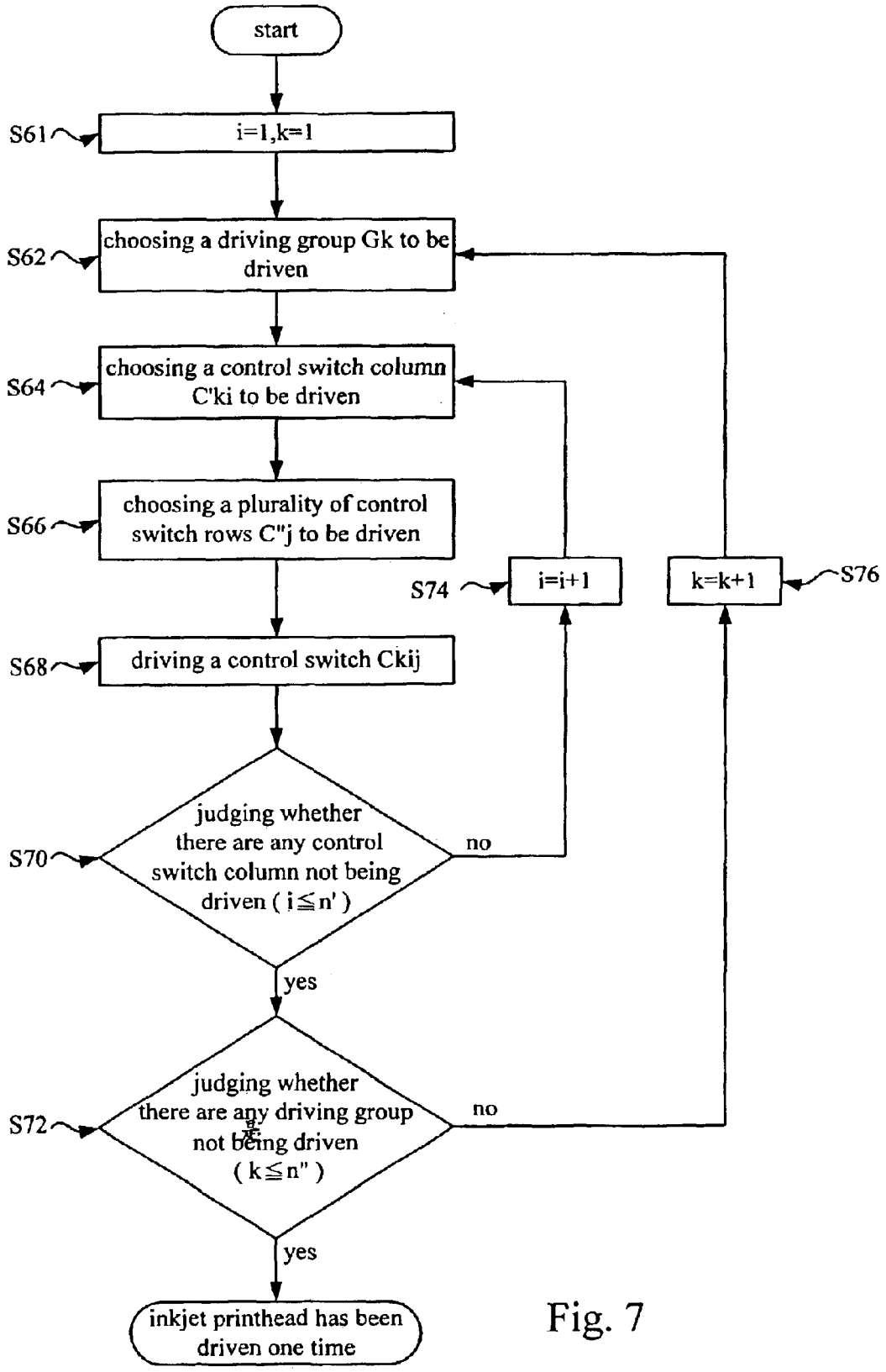
FIG. 7 is a flow chart of the driving method of the driving circuit for a inkjet printhead of the present invention.

Please refer to FIG. 7. FIG. 7 is a flow chart of the driving method of the driving circuit for a inkjet printhead of the present invention. As the FIG. 7 shows, the driving method of the present invention comprises the following steps:

Step S61: setting i=1, k=1; the driving group $G_1$ and control switch column $C_{11}$ being driven;

Step S62: choosing a driving group $G_k$ to be drivenwherein when the driving group $G_k$ is driven, only the control switches of the chosen driving group $G_k$ being driven, while the other control switches not belonging to the chosen driving group $G_k$ are not conducted;

Step S64: choosing a control switch column $C'_{ki}$ to be drivenwherein when the control switch column $C'_{ki}$ is driven, only the control switches of the chosen control switch column $C'_{ki}$ being driven, while the other control switches not belonging to the chosen control switch column $C'_{ki}$ are not conducted;

Step S66: driving all the control switch rows $C''_j$ (j=1~m);

Step S68: the control switch $C_{kij}$ of the corresponding group-driving line, the corresponding column-driving line, and the corresponding row-driving line consequently being conducted;

Step S70: determining whether i<=n', i.e., whether there are still any control switch column $C'_{ki}$ in the driving group $G_k$ not being driven. If YES, going to Step S74, if NO, going to Step S72;

Step S72: determining whether k<=n", i.e., whether there are still any driving group $G_k$ not being driven. If YES, going to Step S76, if NO, going to Step S78;

Step S74: setting i=i+1; going to Step S64, to choose next control switch column;

Step S76: setting k=k+1; going to Step S62 to choose next driving group;

Step S78: all of the driving groups having been driven, END.

Figure 8:
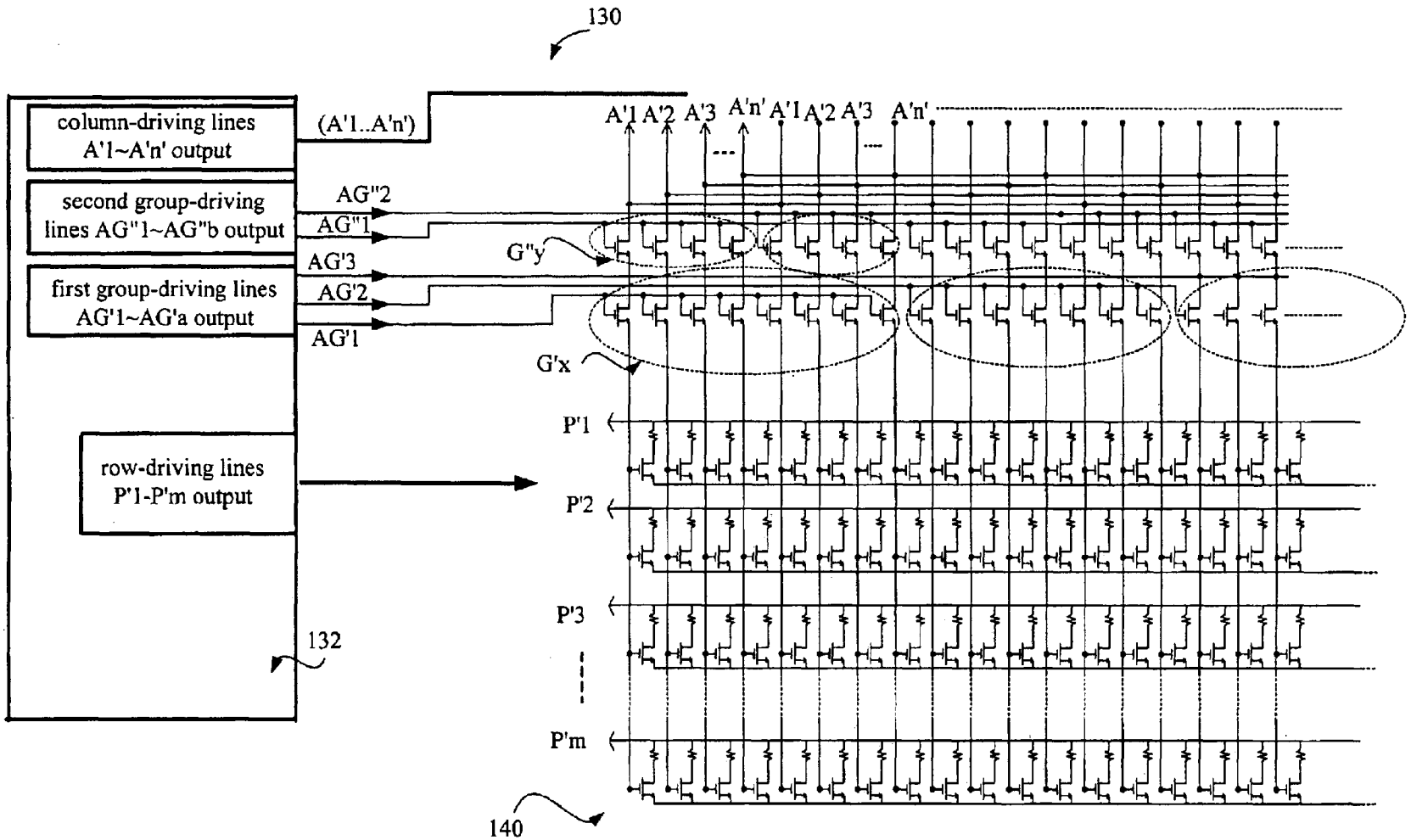
FIG. 8 is a circuit diagram of the second embodiment of the present invention.

Please refer to FIG. 8. FIG. 8 is a circuit diagram of the second embodiment of the present invention. A driving circuit 130 of the second embodiment of the present invention comprises a driving controller 132, a group of first group-driving lines $AG'_x$, a group of second group-driving lines $AG''_y$, and the same group of column-driving lines and row-driving lines described in the first embodiment,. The driving controller 132 generates the driving signals via the group of first group-driving lines $AG'_x$, the group of second group-driving lines $AG''_y$, the group of column-driving lines $A'_i$, and the group of row-driving lines $P'_j$ to drive a inkjet printhead 140. The printhead 140 comprises a plurality of control switches. The plurality of control switches are divided into a plurality of first driving groups $G'_x$ which are driven sequentially by the corresponding group of first group-driving lines $AG'_x$. Each of the first driving group comprises a plurality of second driving groups $G''_y$. When a first driving group $G'_x$ is driven, the plurality of second driving groups $G''_y$ of the first driving group $G'_x$ is driven by the plurality of corresponding second group-driving lines $AG''_y$. And the plurality of second driving groups in different first driving groups are driven by the same group of second group-driving lines. Each second driving group comprises a plurality of control switches and actuators which are arranged in a matrix. The following driving circuit design is the same with the first embodiment, and no redundant description is repeated. In this embodiment, x=1 to a and y=1 to b, that means in the driving circuit 130, (a+b+n'+m) driving lines can control (a×b×n'×m) actuators.

For example, the number of the actuators is fixed, say (n×m). n is further defined to be a×b×n' wherein a, b and n' are all positive integers. Because the mathematical expression a+b+n'<a×b×n' would be valid when a, b and n' are all positive integers larger than one, that would lead to the validity of the following mathematical expression (a+b+n'+m)<(n+m). As we know that the number of driving lines to drive the (n×m) actuators is now (a+b+n'+m), it can be inferred that the number of the driving lines, (a+b+n'+m), would be less than that required in the prior art, which is (n+m), because of (a+b+n'+m)<(n+m). When a=b=n', it can be proved mathematically that the number of the required driving lines would be the minimum. That is to say, the present invention can control the same number of (n×m) actuators in the minimal number of driving lines, by reducing the originally required number (n+m) to the smaller number of (a+b+n'+m)

The second embodiment mentioned above can be realized in that the group of group-driving lines in the first embodiment are divided into a group of first group-driving lines and a group of second group-driving lines. However, people skilled in the art would knowthat the group of group-driving lines can be further divided into a multi-levels of group-driving lines so as to reduce the substantial number of total driving lines, such as to divide another group of third group-driving lines $AG'''_z$ etc. It's all within the spirit and goal of the present invention.

From the above teaching, the present invention achieves the objective of improving the efficiency of the conventional address lines. Specifically, the present invention controls the same number of the actuators at a reduced number of driving lines, or in another sense, utilizes the same number of driving lines to control more actuators. Besides, the driving circuit of the present invention doesn't substantially change the fabrication procedures of the conventional driving circuit. And the driving circuit can be integrated in the printhead, or partially integrated and partially built out of the printhead, which can substantially achieve the same objective of the present invention.

While the invention has been described in several preferred embodiments, it is understood that the words which have been used are words of description rather than words of limitation and that changes within the purview of the appended claims may be made without departing from the scope and spirit of the invention in its broader aspect.

What is claimed is:

1. A driving circuit for an inkjet printhead, the driving circuit comprising a group of group-driving lines, a group of column-driving lines, and a group of row-driving lines to drive the printhead, and a plurality of driving groups to be driven by the group of group-driving lines; each driving group comprising a plurality of actuators and control switches to be driven by the corresponding column-driving lines and row-driving lines; when a control switch is driven, a corresponding actuator being accordingly driven; wherein the plurality of control switches in different driving groups are driven by the same group of column-driving lines and the same group of row-driving lines, and wherein when a driving group is driven by a corresponding group-driving line, only the control switches of the aforementioned driving group being driven by the corresponding column-driving lines and row-driving lines at the same time are conducted, the other control switches not of the aforementioned driving group are not conducted.

2. The driving circuit of claim 1, wherein the driving circuit comprises a driving controller for generating driving signals via the group of group-driving lines, the group of column-driving lines, and the group of row-driving lines to drive the corresponding control switches in the printhead.

3. The driving circuit of claim 1, wherein each actuator actuates a corresponding ink chamber for ejecting ink therein.

4. The driving circuit of claim 1, wherein the driving circuit comprises n' group-driving lines, n" column-driving lines, and m row-driving lines, and drives totally n'×n"×m control switches and corresponding actuators.

5. The driving circuit of claim 1, wherein the group of group-driving lines are further divided into a group of first group-driving lines and a group of second group-driving lines, and each driving group comprises a plurality of first driving groups driven by the corresponding first group-driving lines, and each first driving group comprises a plurality of second driving groups comprising a plurality of control switches and actuators, and when a first driving group is driven, a plurality of second driving groups of the first driving group is driven by the group of corresponding second group-driving lines, and wherein the plurality of second driving groups in the different first driving groups are driven by the same group of second group-driving lines.

6. The driving circuit of claim 5, wherein the group of group-driving lines are further divided into a multi-levels of group-driving lines.

7. The driving circuit of claim 1, wherein the driving circuit is built in the printhead.

8. A driving circuit for an inkjet printhead comprising a plurality of driving groups, each driving group comprising a plurality of control switches and actuators, the plurality of control switches and actuators being arranged to a plurality of control switch columns and control switch rows, the driving circuit comprising:

a group of group-driving lines, for choosing the plurality of corresponding driving groups to be driven; when a driving group is driven by a corresponding group-driving line, only the control switches of the aforementioned driving group being driven, the other control switches not of the aforementioned driving group are not conducted;

a group of column-driving lines, for choosing the plurality of corresponding control switch columns to be driven;

a group of row-driving lines, for choosing the plurality of corresponding control switch rows to be driven;

when a control switch is chosen together by a corresponding group-driving line, a corresponding column-driving line, and a corresponding row-driving line, the control switch is conducted to drive a corresponding actuator.

9. The driving circuit of claim 8, wherein the plurality of control switches in the different driving groups are driven by the same group of column-driving lines and the same group of row-driving lines; and the group of group-driving lines decide which driving group to be driven.

10. The driving circuit of claim 8, wherein the driving circuit comprises a driving controller for generating driving signals via the group of group-driving lines, the group of column-driving lines, and the group of row-driving lines to drive the corresponding control switches in the printhead.

11. The driving circuit of claim 8, wherein each actuator actuates a corresponding ink chamber for ejecting ink therein.

12. The driving circuit of claim 8, wherein the driving circuit comprises n' group-driving lines, n" column-driving lines, and m row-driving lines, and drives totally n'×n"×m control switches and corresponding actuators.

13. The driving circuit of claim 8, wherein the group of group-driving lines are further divided into a group of first group-driving lines and a group of second group-driving lines, and each driving group comprises a plurality of first driving groups driven by the corresponding first group-driving lines, and each first driving group comprises a plurality of second driving groups comprising a plurality of control switches and actuators, and when a first driving group is driven, a plurality of second driving groups of the first driving group is driven by the group of corresponding second group-driving lines, and wherein the plurality of second driving groups in the different first driving groups are driven by the same group of second group-driving lines.

14. The driving circuit of claim 13, wherein the group of group-driving lines are further divided into a multi-levels of group-driving lines.

15. The driving circuit of claim 8, wherein the driving circuit is built in the printhead.

16. A driving method for an inkjet printhead comprising a plurality of driving groups, each driving group comprising a plurality of control switches and actuators, the plurality of control switches and actuators being arranged to a plurality of control switch columns and control switch rows, the driving method comprising:

choosing a driving group to be driven; when the driving group is driven, only the control switches of the aforementioned driving group being driven, the other control switches not of the aforementioned driving group are not conducted;

choosing a control switch column to be driven; and choosing a plurality of control switch rows to be driven;

wherein, when a control switch is chosen together by a corresponding group-driving line, a corresponding column-driving line, and a corresponding row-driving line, the control switch is conducted to drive a corresponding actuator.

17. The driving method of claim 16, wherein the plurality of control switch in the printhead are driven by a group of group-driving lines, a group of column-driving lines, and a group of row-driving lines.

18. The driving method of claim 17, wherein the plurality of control switches of the different driving groups are driven by the same group of column-driving lines and the same group of row-driving lines.

19. The driving method of claim 17, wherein the driving circuit comprises n' group-driving lines, n" column-driving lines, and m row-driving lines, and drives totally n'×n"×m control switches and corresponding actuators.

20. The driving method of claim 17, wherein the group of group-driving lines are further divided into a group of first group-driving lines and a group of second group-driving lines, and each driving group comprises a plurality of first driving groups driven by the corresponding first group-driving lines, and each first driving group comprises a plurality of second driving groups comprising a plurality of control switches and actuators, and when a first driving group is driven, a plurality of second driving groups of the first driving group is driven by the group of corresponding second group-driving lines, and wherein the plurality of second driving groups in the different first driving groups are driven by the same group of second group-driving lines.

21. The driving method of claim 20, wherein the group of group-driving lines further divided into a multi-levels of group-driving lines.

22. The driving method of claim 16, wherein each actuator actuates a corresponding ink chamber for ejecting ink therein.

* * * * *

UNITED STATES PATENT AND TRADEMARK OFFICE

CERTIFICATE OF CORRECTION

PATENT NO. : 6,817,703 B2
APPLICATION NO. : 10/353207
DATED : November 16, 2004
INVENTOR(S) : Lee It is certified that error appears in the above-identified patent and that said Letters Patent is hereby corrected as shown below:

On the Title Page, Item (75), under "Inventor", in Column 1, Line 1, delete "Cheng-Loung Lee," and insert -- Cheng-Lung Lee, --, therefor.

In the Drawings:

In Fig. 7, Sheet 7 of 8, delete " 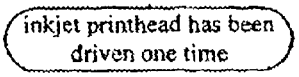

" and insert -- 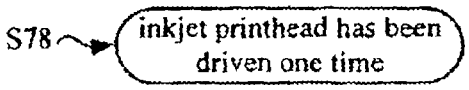

--, therefor.

In the Specifications:

In Column 1, Line 7, delete "a inkjet" and insert -- an inkjet --, therefor at each occurrence throughout the specification.

In Column 4, Line 18, delete "($AGP_1$)" and insert -- (for example, $AGP_1$) --, therefor.

In Column 4, Line 18, delete "($A'P_1$)" and insert -- (for example, $A'P_1$) --, therefor.

In Column 4, Line 28, delete "($CP_{11}$)" and insert -- (for example, $CP_{11}$) --, therefor.

In Column 4, Line 28, delete "($P'P_1$)" and insert -- (for example, $P'P_1$) --, therefor.

In Column 4, Lines 58-59, delete "(C"1 to C"m)." and insert -- ($C''_1$ to $C''_m$). --, therefor.

In Column 5, Line 27, delete "$C_{11}$" and insert -- $C'_{11}$ --, therefor.

In Column 5, Line 28, delete "drivenwherein" and insert -- driven wherein --, therefor.

Signed and Sealed this
Eighteenth Day of June, 2013

Teresa Stanek Rea
*Acting Director of the United States Patent and Trademark Office*

In Column 5, Line 34, delete “drivenwherein” and insert -- driven wherein --, therefor.

In Column 5, Line 46, delete “S74,” and insert -- S72, --, therefor.

In Column 5, Line 47, delete “S72;” and insert -- S74; --, therefor.

In Column 5, Line 50, delete “S76,” and insert -- S78, --, therefor.

In Column 5, Line 50, delete “S78;” and insert -- S76; --, therefor.

In Column 5, Line 51, delete “S64,” and insert -- S64 --, therefor.

In Column 6, Line 35, delete “(a+b+n'+m)” and insert -- (a+b+n'+m). --, therefor.

In Column 6, Line 40, delete “knowthat” and insert -- know that --, therefor.